US008061574B2

(12) United States Patent
Lesser et al.

(10) Patent No.: US 8,061,574 B2
(45) Date of Patent: Nov. 22, 2011

(54) APPARATUS FOR SETTING FASTENING ELEMENTS

(75) Inventors: Hans-Jurgen Lesser, Rheinfelden (DE); Martin Busch, Efringen-Kirchen (DE); Patrice Burg, Steinbrunn-le-Bas (FR)

(73) Assignee: A. Raymond et Cie, Grenoble (FR)

( * ) Notice: Subject to any disclaimer, the term of this patent is extended or adjusted under 35 U.S.C. 154(b) by 440 days.

(21) Appl. No.: 12/063,263

(22) PCT Filed: Sep. 14, 2006

(86) PCT No.: PCT/EP2006/008936

§ 371 (c)(1),
(2), (4) Date: Feb. 8, 2008

(87) PCT Pub. No.: WO2007/057066

PCT Pub. Date: May 24, 2007

(65) Prior Publication Data

US 2010/0147920 A1 Jun. 17, 2010

(30) Foreign Application Priority Data

Nov. 17, 2005 (DE) ..... 10 2005 054 719

(51) Int. Cl.
*B25C 1/10* (2006.01)

(52) U.S. Cl. ..... 227/131; 227/130

(58) Field of Classification Search ..... 227/131, 227/136, 138, 73, 75, 135, 137; 173/2, 170, 173/176; 81/434, 473; 29/243.526; 72/391.6
See application file for complete search history.

(56) References Cited

U.S. PATENT DOCUMENTS

| | | | | |
|---|---|---|---|---|
| 3,095,106 | A * | 6/1963 | Morrison | 29/243.526 |
| 4,321,814 | A | 3/1982 | Martin | |
| 4,901,610 | A * | 2/1990 | Larson et al. | 81/473 |
| 5,207,085 | A * | 5/1993 | Hopkins et al. | 72/391.6 |
| 5,890,405 | A * | 4/1999 | Becker | 81/434 |
| 5,988,025 | A * | 11/1999 | Sasaki et al. | 81/434 |
| 6,186,035 | B1 * | 2/2001 | Jalbert et al. | 81/434 |
| 7,073,699 | B2 | 7/2006 | Seidler | |

FOREIGN PATENT DOCUMENTS

| | | | |
|---|---|---|---|
| DE | 19643656 | A1 | 4/1998 |
| EP | 0838284 | A2 | 4/1998 |
| WO | WO98/10900 | A1 | 3/1998 |
| WO | WO03/070429 | A1 | 8/2003 |

* cited by examiner

*Primary Examiner* — Rinaldi Rada
*Assistant Examiner* — Nathaniel Chukwurah
(74) *Attorney, Agent, or Firm* — Baker & Daniels LLP

(57) ABSTRACT

An apparatus for setting fastening elements (5) has a feed drive (21), by means of which the connecting elements (5) can be fed to an installation position, and a setting device which has a setting tool and by means of which a fastening element (5) arranged in the installation position can be ejected to come into engagement with a support part. Also present is a drive mechanism, which is provided with a drive motor that has a rotatable drive shaft (13) and is coupled via a transmission arrangement (14, 15, 16, 17, 18) to the feed drive (21) and the setting device (30), and with a control arrangement for setting the direction of rotation of the drive shaft (13). In one direction of rotation of the drive shaft (13), the transmission arrangement (14, 15, 16, 17, 18) couples the drive motor (12) to the feed drive (21), and in the other direction of rotation of the drive shaft (13), it couples the drive motor (12) to the setting device. The apparatus is therefore relatively easy to handle.

10 Claims, 6 Drawing Sheets

APPARATUS FOR SETTING FASTENING ELEMENTS

BACKGROUND OF THE INVENTION

1. Field of the Invention

The invention provides a device for setting fastening elements.

2. Description of the Related Art

One apparatus for setting fastening elements is known from DE 196 43 656 A1. The prior apparatus, which is designed to set connecting elements that are configured with a flat plate and a pin that is set against the flat plate, has a feed drive by means of which the fastening elements, connected to each other via connecting elements, can be fed from a magazine to an installation position. Also present is a setting device equipped with a pushing tool, by means of which a fastening element disposed in the installation position can be ejected from the apparatus to come into engagement with a support part.

SUMMARY OF THE INVENTION

The present invention provides an apparatus for setting fastening elements that is distinguished by relatively easy handling.

In the apparatus according to the invention, the sole drive motor is used both to feed and to set the fastening elements. The device according to the invention can therefore be constructed with a relatively low weight, which makes it much easier to handle, especially in connection with the conveyor-belt installation of fastening elements.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
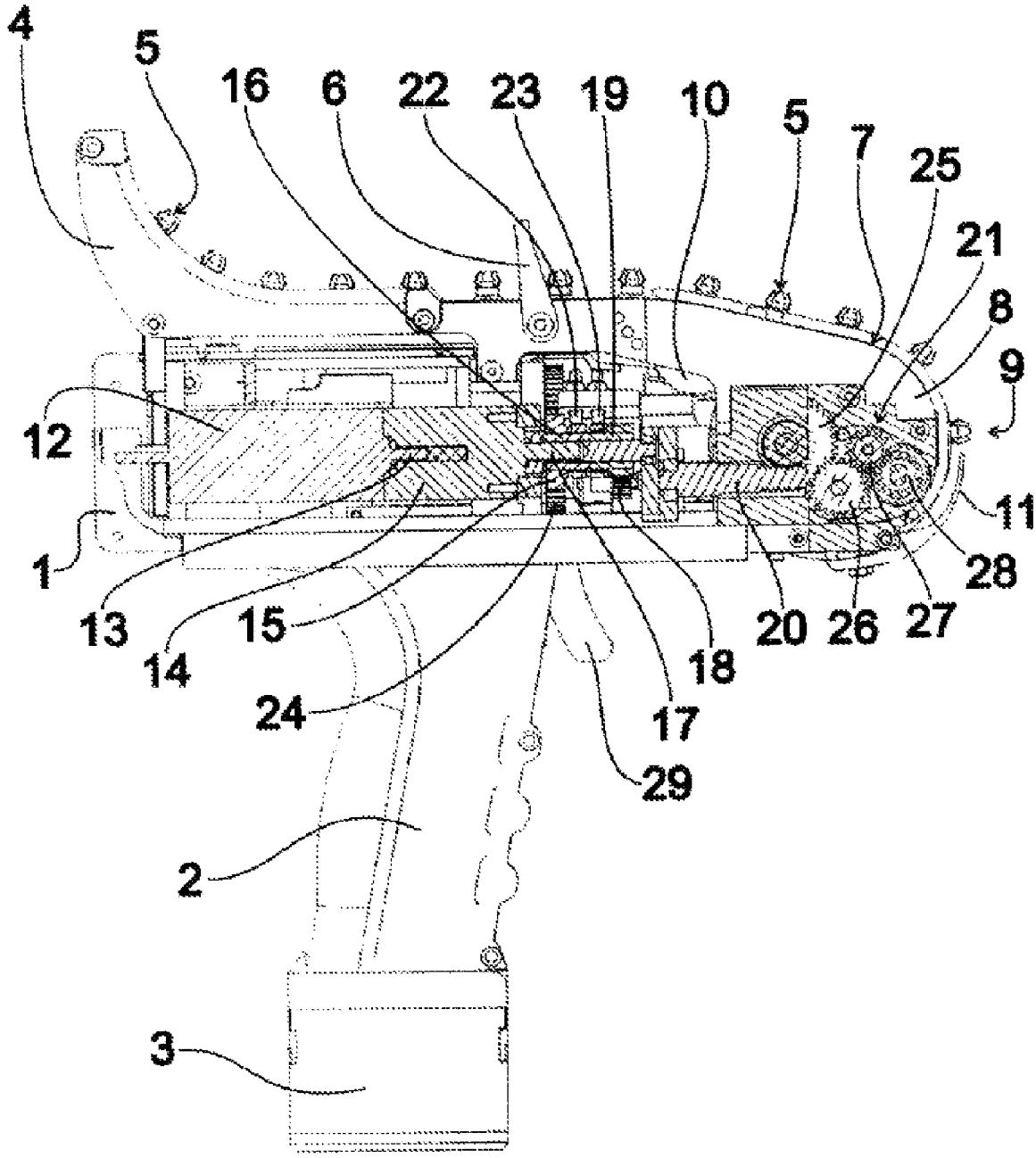
FIG. 1 is a partially cut-away side view of an exemplary embodiment of an apparatus according to the invention, comprising a feed drive and a setting device that are drivable by a single drive motor.

Corresponding reference characters indicate corresponding parts throughout the several views. Although the exemplifications set out herein illustrate embodiments of the invention, in several forms, the embodiments disclosed below are not intended to be exhaustive or to be construed as limiting the scope of the invention to the precise forms disclosed.

DETAILED DESCRIPTION

FIG. 1 shows an exemplary embodiment of an apparatus according to the invention in a partially cut-away side view.

The illustrated exemplary embodiment comprises an elongated housing 1, to which a handgrip 2 is attached in the manner a gun. A battery pack 3 is detachably fitted to the handgrip 2 on the opposite side from the housing 1.

Built onto the housing 1 on the opposite side from the handgrip 2 is an entrance trackway 4, to which can be fed fastening elements connected to each other via connecting elements and coming from a supply container or quasi-endlessly from a roll (not shown in FIG. 1). A supply container is preferably configured in a screw-like manner, with a receiving trackway disposed spirally one inside the other, in order to store a large number of fastening elements in a relatively small space.

In the exemplary embodiment shown, the fastening elements are configured as expansion rivets 5, which move from entrance trackway 4 under a fixing eyelet 6, which is screwed onto the housing 1 and is configured in the manner of a leg, and on into a feed trackway 7 integrated into the housing 1. The feed trackway 7 passes around a rounded housing head 8 and comprises, disposed in the longitudinal direction of the housing 1, an end face 9 against which the expansion rivets 5 can be positioned in an installation position. An expansion rivet 5 is arranged in the installation position in the representation of FIG. 1.

The expansion rivets 5 are usefully arranged between two edge strips, not shown in FIG. 1, which serve as connecting elements and are configured on one side with an engaging structure, such as, for example, a set of ribs or teeth disposed on one side, or a series of evenly spaced recesses. When the expansion rivets 5 are properly arranged, an entrance guard wheel 10 rotatably mounted in the housing 1 engages in this engaging structure to ensure proper delivery to end face 9.

Built onto the housing 1, on the side of end face 9 that faces away from feed trackway 7, is a release flap 11, which is spacedly disposed relative to housing 1, projects by its free end into the region of end face 9, and is able to pivot in the direction of housing 1 against a spring force. Release flap 11, by cooperating with an inductive enabling sensor, serves to control the installation cycle in that a feed of the expansion rivets 5 is enabled only when the release flap 11 is in the position shown in FIG. 1, where it is not pivoted inward and thus is maximally distant from the housing 1.

Present in the housing 1 is a drive mechanism comprising a single, electrically powered drive motor 12 that is supplied with electrical energy by the battery pack 3. Drive motor 12 has a rotatable drive shaft 13, coupled to a motor control gear 14 of a transmission arrangement. The transmission arrangement is further equipped with a sliding drive gear 15, which is coupled to a gear shaft 17 of the motor control gear 14 via a control idler 16, as an idler that engages in a first direction of rotation of drive shaft 13. The transmission arrangement is further configured with a worm shaft drive gear 18, which is coupled to a worm shaft 20 of a feed drive 21 via a feed idler 19 that stands in engagement with gear shaft 17. Feed idler 19 acts as an idler that engages in a second direction of rotation of drive shaft 13 that is opposite to the aforesaid first direction of rotation.

The exemplary embodiment of the invention illustrated in FIG. 1 further comprises an inductive displacement position sensor 22 that is part of a control arrangement and that serves to detect the position of the sliding drive gear 15 by detecting counting pulses and routing them to a status electronics of a control arrangement. In addition, in the described exemplary embodiment of the invention, the control arrangement is equipped with an inductive feed position sensor 23 by means of which the position of the worm shaft drive gear 18 can be detected via the control electronics, for example via counting pulses.

The rotation of the gear shaft 17 can thus be imparted, on the one hand, via sliding drive gear 15 to a control shaft gear 24, and on the other hand, via worm shaft 20 to an intermeshing series of feed drive gears 25, 26, 27, 28 of feed drive 21, in order to deliver the expansion rivets 5 to end face 9.

It can further be understood from FIG. 1 that the exemplary embodiment of the invention comprises, as another component of the control arrangement, a control member 29 that is configured in the manner of a gun trigger and is connected to the control electronics so as to drive the drive motor 12 in a series of mutually opposite directions of rotation in a manner explained in more detail below, in order to bring an expansion rivet 5 at end face 9 into an installation position, which is preferably monitored by a sensing device, and set it.

Figure 2:
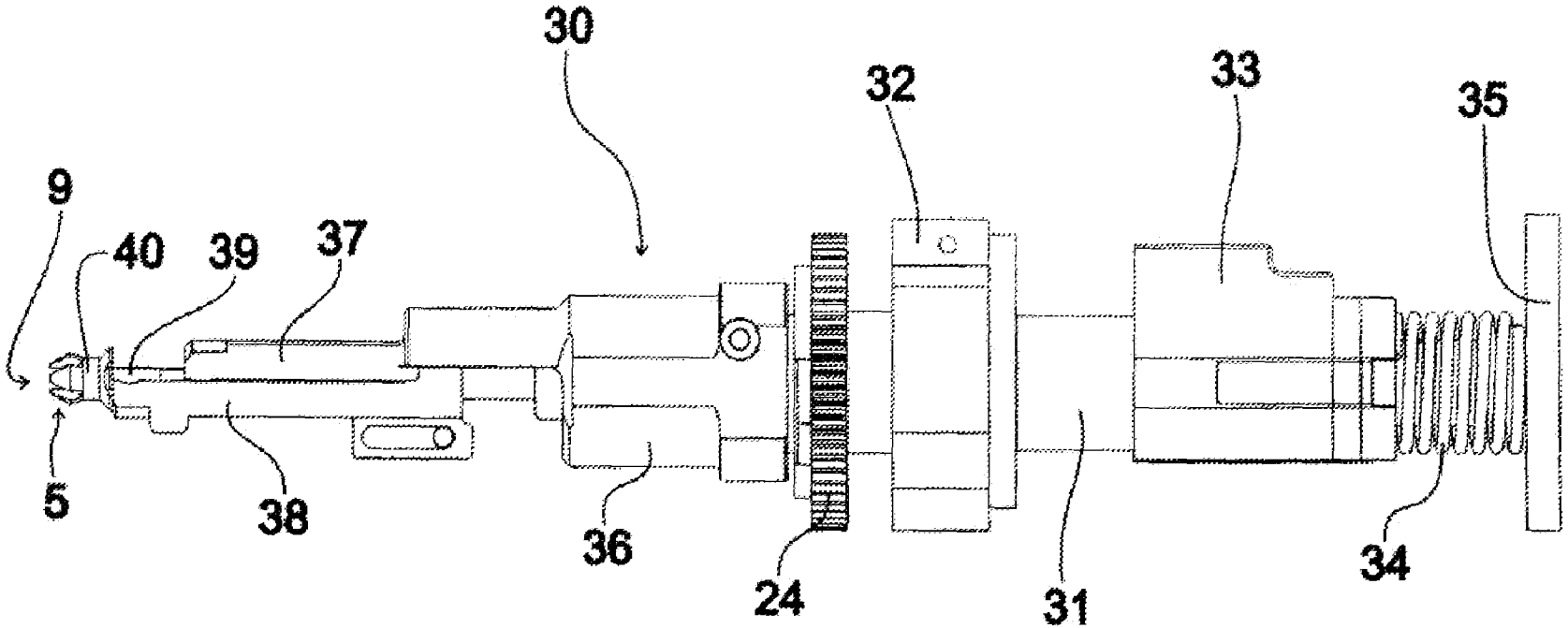
FIG. 2 shows parts of the setting device that are essential to the functionality of the inventive apparatus according to FIG. 1 in a home position, prior to the start of the setting operation.

FIG. 2 shows essential elements of the setting device 30 of the exemplary embodiment explicated in FIG. 1, the view represented in FIG. 2 being taken from the opposite side from the viewing direction of FIG. 1. The control shaft gear 24 is rotationally fixedly connected to a control shaft 31, which is rotatably mounted in a control shaft support 32. Coupled to control shaft 31 is, on the one hand, a firing pin bushing 33, which surrounds control shaft 31 and is disposed on the opposite side of control shaft support 32 from control shaft gear 24. A tension compression spring 34 bears against the opposite side of firing pin bushing 33 from control shaft support 32, and abuts by its other end against a thrust plate 35 that is connected to housing 1, which is not shown in FIG. 2.

The setting device 30 further comprises a sliding bushing 36, which is disposed on the opposite side of control shaft gear 24 from control shaft support 32 and is slidable in the longitudinal direction of control shaft 31. Sliding bushing 36 stands connected to one end of a slide 37, as a setting tool, which extends in the longitudinal direction of control shaft 31 and whose other end points toward the end face 9 of the inventive apparatus.

It can further be understood from the representation of FIG. 2 that the setting device 30 comprises a receiving part 38 that is fixedly disposed relative to housing 1, and in which, in the illustrated exemplary embodiment according to FIG. 2, there is disposed an expansion rivet shank 39 that is part of an expansion rivet 5 and that is to be slid during a setting operation into an expansion rivet body 40 that receives said expansion rivet shank 39.

In the home position depicted in FIG. 2, firing pin bushing 33 is disposed at a distance from control shaft support 32, such that tension compression spring 34 exerts a relatively high bias on firing pin bushing 33. In the home position, sliding bushing 36 is disposed near control shaft gear 24, such that slide 37 is maximally retracted with respect to end face 9, and, during a feed process brought about by feed drive 21, expansion rivet shank 39 can be seated in the end region of receiving part 38 that faces end face 9.

Figure 3:
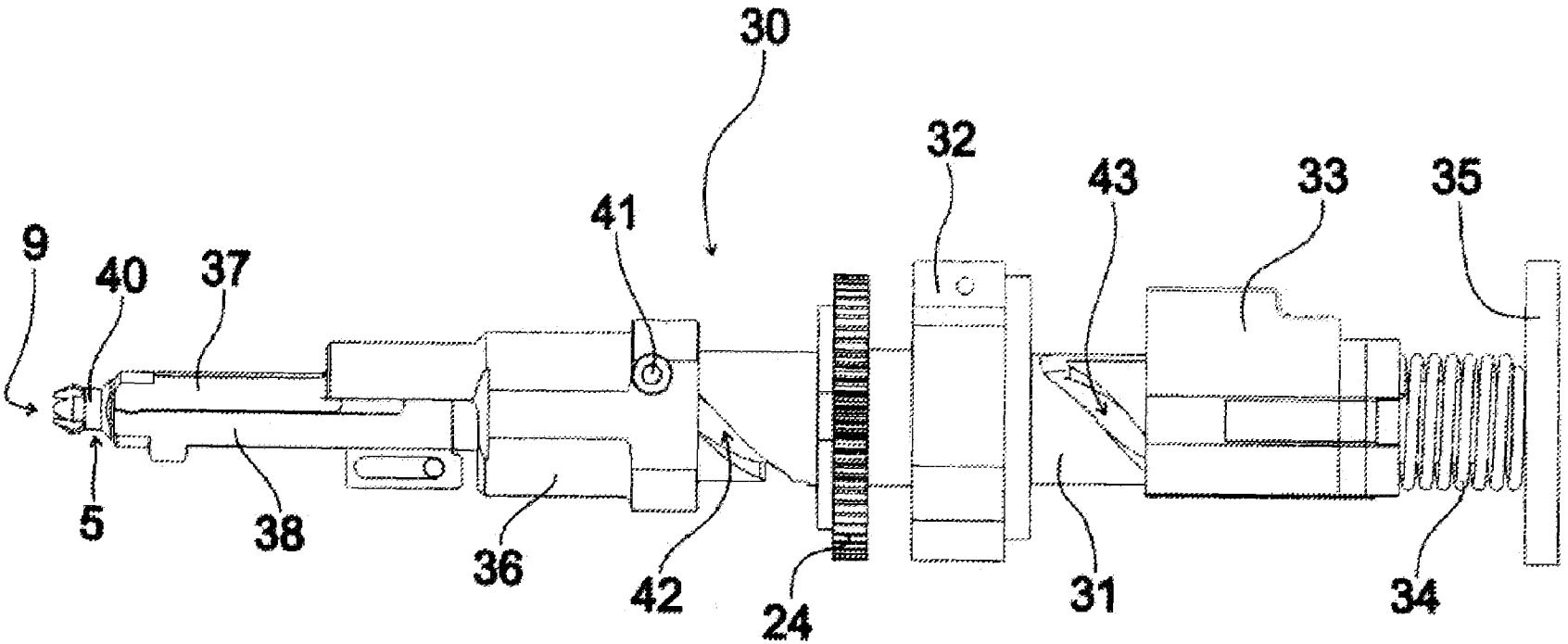
FIG. 3 shows parts of the setting device that are essential to the functionality of the inventive apparatus according to FIG. 1 in a biased position.

FIG. 3 shows the arrangement according to FIG. 2 in a biased position, in which, after control shaft 31 has rotated due to the rotation of drive shaft 13 in the first direction of rotation, by virtue of the compulsory movement of a sliding-bushing slot pin 41, which stands in engagement with sliding bushing 36, in a sliding-bushing control slot 42 sunk in control shaft 31, slide 37 is shifted into a position in which it terminates, by its end directed toward end face 9, flush with the corresponding end of receiving part 38, such that expansion rivet shank 39 is covered and expansion rivet body 40 rests against slide 37, the expansion rivet 5 previously having been separated from the connecting elements and thereby singulated by a slight overshooting movement of the slide 37.

It can further be appreciated from the arrangement of the control shaft 31 depicted in FIG. 3 that a firing pin bushing control slot 43 is formed in control shaft 31 on the opposite side of control shaft support 32 from control shaft gear 24.

Figure 4:
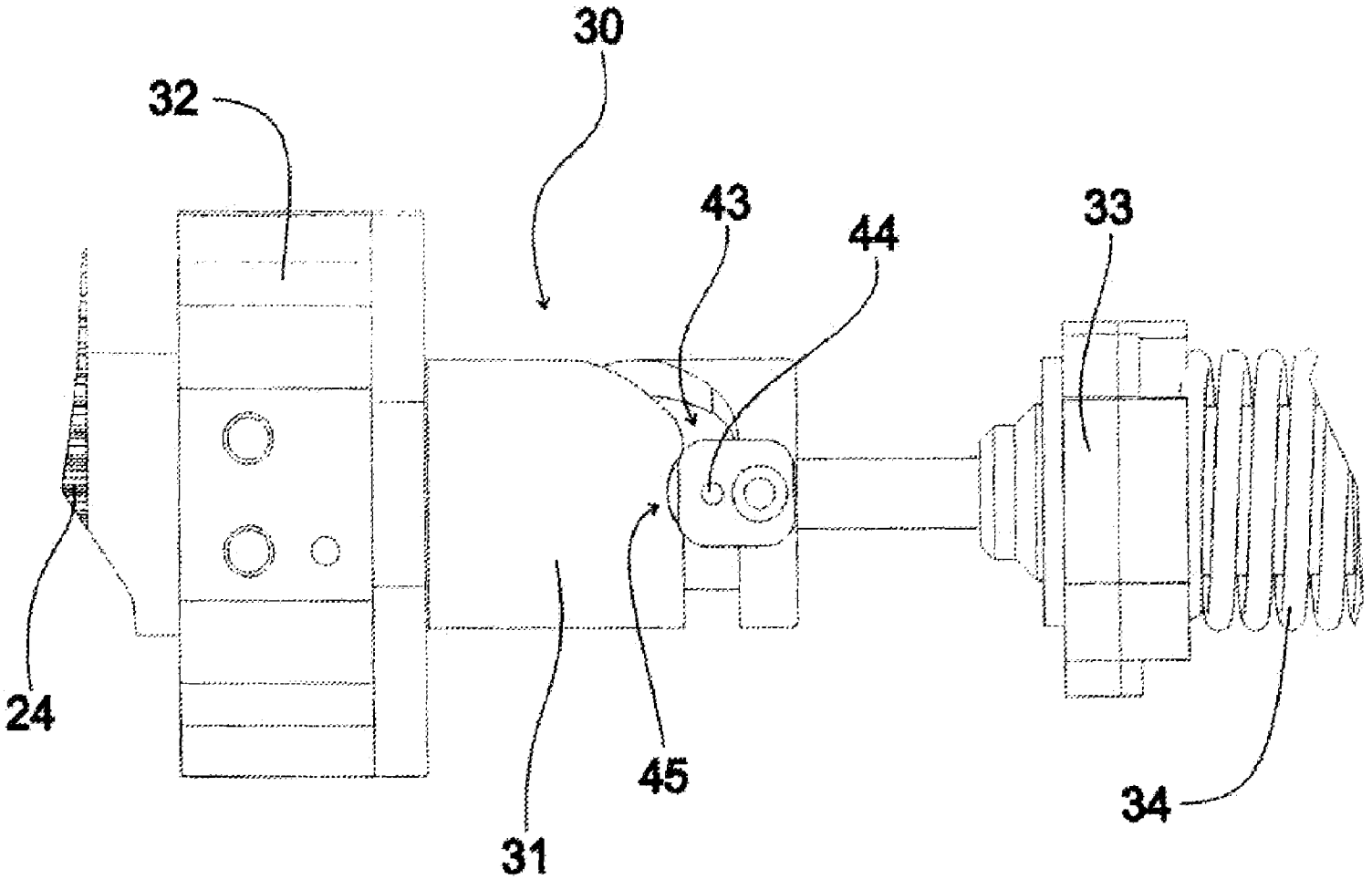
FIG. 4 shows the arrangement of FIG. 3 in detail in the region of a control slot for movement of a firing pin bushing.

FIG. 4 shows the arrangement according to FIG. 2 in a region in which firing pin bushing 33 is arranged in the home position, the outer jacket of firing pin bushing 33 being removed in FIG. 4. It can be seen from FIG. 4 that a firing pin bushing control pin 44 connected to firing pin bushing 33 travels in firing pin bushing control slot 43 and in the home position rests in a home position recess 45. Firing pin bushing control slot 43 is configured in this case such that when control shaft 31 rotates away from the home position according to FIG. 2 into the biased position according to FIG. 3, firing pin bushing 33 remains in the biased position, while, as can be seen from FIG. 3, sliding-bushing control pin 41 slides in the correspondingly configured sliding-bushing control slot 42 in such a way that sliding bushing 36 is shifted into the position illustrated in FIG. 3.

Figure 5:
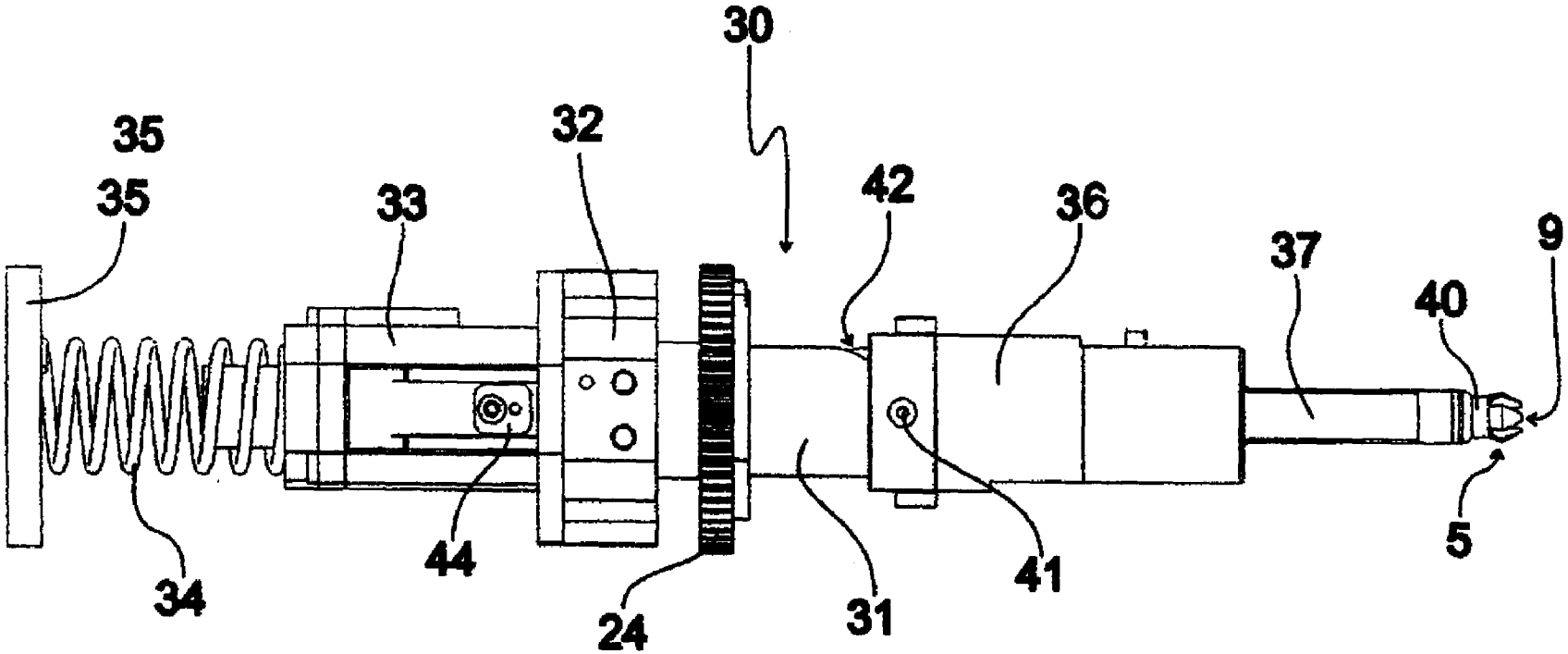
FIG. 5 shows parts of the setting device that are essential to the functionality of the inventive apparatus according to FIG. 1 in a final position.

FIG. 5 shows the exemplary embodiment according to FIG. 1 in a final position after the completion of a setting operation initiated after the actuation of control member 29. When control member 29 is actuated, control shaft 31 is rotated so far by the further rotation of drive shaft 13 in the first direction of rotation that firing pin bushing 33, which in one position of the control shaft 31 is able to slide freely in the longitudinal direction of control shaft 31, is abruptly shifted, by the bias of tension compression spring 34, with high momentum in the direction of control shaft support 32. Due to the transfer of momentum to slide 37, expansion rivet shank 39 is shot into expansion rivet body 40, which is disposed in a recess provided for this purpose in the support part, it being the case that before being shot in, expansion rivet shank 39 has its end face that is directed away from expansion rivet body 40 resting against a wall section that is set back from the working end of the slide 37. The expansion rivet 5 is thereby set.

Figure 6:
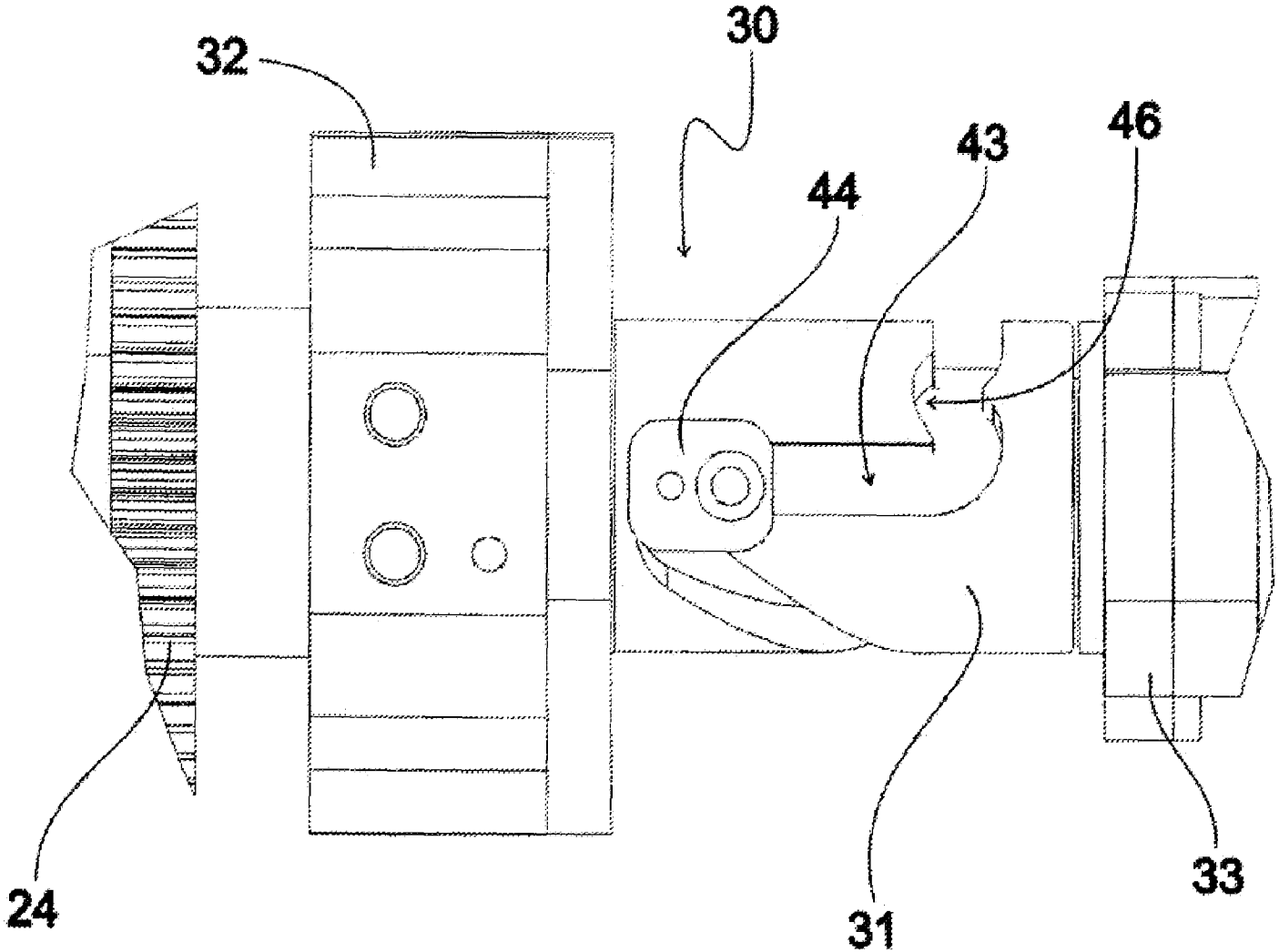
FIG. 6 shows the arrangement of FIG. 5 in the region of the control slot for the firing pin bushing.

FIG. 6 shows the arrangement according to FIG. 5 with the firing pin bushing 33 removed, as in FIG. 4. It can be seen from FIG. 6 that firing pin bushing control slot 43 comprises a biased-position recess 46 in which firing pin bushing control pin 44 was disposed when in the biased position. FIG. 6 also reveals the section of firing pin bushing control slot 43 that extends in the longitudinal direction of control shaft 31 and allows firing pin bushing 33 to slide freely in the direction of control shaft support 32. Proceeding from the arrangement according to FIG. 6, when control shaft 31 automatically executes a further rotation to assume the home position after the actuation of control member 29 to shoot in expansion rivet shank 39, firing pin bushing 33 is shifted back into the arrangement according to FIG. 2 by the rotation of the drive shaft 13 in the first direction of rotation in a segment that ascends in the direction of tension compression spring 34, while sliding bushing 36 is also shifted into the home position, [i.e.] the arrangement illustrated in FIG. 2, under the effect on sliding-bushing control pin 41 of a similarly inclined segment of sliding-bushing control slot 42.

Immediately after firing pin bushing 33 and sliding bushing 36 assume the home position, the direction of rotation of drive shaft 13 is switched under the control of the control electronics to the second direction of rotation, causing setting device 30 to be uncoupled by means of control idler 16 and feed drive 21 to be activated by the then engaging feed idler 19, causing the next expansion rivet 5 to be shifted into the installation position.

It is understood that by suitable configuration in the region of the slide 37 and the receiving part 38, the apparatus can also be laid out for fastening elements other than expansion rivets 5 without departing from the scope of the present invention.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. An apparatus for setting fastening elements, the fastening elements connected to each other by connecting elements, said apparatus comprising:

a feed drive successively moving the connecting elements into an installation position via a feed arrangement;

a setting device including a linearly movable setting tool operable to eject a fastening element from the installation position into engagement with a support part; and a drive mechanism, comprising:

a single drive motor having a rotatable drive shaft, said drive shaft rotatable in a first direction and rotatable in a second, opposite direction;

a control arrangement controlling rotation of said drive shaft; and a transmission arrangement drivably coupling said drive shaft only to said feed drive in said first direction of rotation of said drive shaft, and drivably coupling said drive shaft only to said setting device in said second direction of rotation of said drive shaft to linearly move said setting tool.

2. The apparatus of claim 1, wherein said transmission arrangement includes a pair of idlers, one for each of the two directions of rotation of said drive shaft.

3. The apparatus of claim 2, wherein said setting device includes a control shaft on which a sliding bushing connected to said setting tool is mounted, said sliding bushing slidable in a longitudinal direction of said control shaft between an advanced position and a retracted position.

4. The apparatus of claim 3, wherein said control shaft includes a sliding-bushing control slot, and said setting device further includes a sliding-bushing control pin connected to said sliding bushing and engaging within said sliding-bushing control slot, said sliding-bushing control pin controlling movement of said sliding bushing.

5. The apparatus of claim 3, wherein said setting device includes a firing pin bushing mounted for sliding movement in the longitudinal direction of said control shaft between a retracted position and an advanced position, said firing pin bushing cooperating with said setting tool to eject the fastening element.

6. An apparatus for setting fastening elements, the fastening elements connected to each other by connecting elements, said apparatus comprising:

a feed drive successively moving the connecting elements into an installation position via a feed arrangement;

a setting device including a linearly movable setting tool operable to eject a fastening element from the installation position into engagement with a support part; and a drive mechanism, comprising:

a drive motor having a rotatable drive shaft;

a control arrangement controlling rotation of said drive shaft; and a transmission arrangement coupling said drive shaft to said feed drive in one direction of rotation of said drive shaft, and coupling said drive shaft to said setting device in the other direction of rotation of said drive shaft, wherein said transmission arrangement includes a pair of idlers, one for each of the two directions of rotation of said drive shaft, wherein said setting device includes a control shaft on which a sliding bushing connected to said setting tool is mounted, said sliding bushing slidable in a longitudinal direction of said control shaft between an advanced position and a retracted position, wherein said setting device includes a firing pin bushing mounted for sliding movement in the longitudinal direction of said control shaft between a retracted position and an advanced position, said firing pin bushing cooperating with said setting tool to eject the fastening element, and wherein said control shaft includes a firing pin bushing control slot, and said setting device further includes a firing pin bushing control pin connected to said firing pin bushing and engaging within said firing pin bushing control slot, said firing pin bushing control pin controlling the movement of said firing pin bashing.

7. The apparatus of claim 1, wherein said setting tool separates a fastening element from the connecting elements prior to ejecting the fastening element.

8. The apparatus of claim 1, wherein said fastening elements comprise expansion rivets, each expansion rivet including an expansion rivet body and an expansion rivet shank, and said setting tool of said setting device acts on said expansion rivet shank.

9. The apparatus of claim 8, wherein said setting device includes a tension compression spring wherein, to eject an expansion rivet, said setting tool is shifted to a biased position in which said tension compression spring exerts a force on a bushing coupled to said setting tool, the force acting in the direction of the expansion rivet and, after actuation of a control member of said control arrangement, said setting tool pushes the expansion rivet shank into the expansion rivet body.

10. The apparatus of claim 5, wherein said control shaft includes a firing pin bushing control slot, and said setting device further includes a firing pin bushing control pin connected to said firing pin bushing and engaging within said firing pin bushing control slot, said firing pin bushing control pin controlling the movement of said firing pin bushing.

* * * * *